US008273287B2

(12) United States Patent
Pammer et al.

(10) Patent No.: US 8,273,287 B2
(45) Date of Patent: Sep. 25, 2012

(54) SYSTEM FOR THE PRODUCTION OF ORE WITH GREEN AGGLOMERATES CONTAINING A PROPORTION OF FINES

(75) Inventors: Oskar Pammer, Linz (AT); Hans Stiasny, Linz (AT)

(73) Assignee: Siemens Vai Metals Technologies GmbH (AT)

( * ) Notice: Subject to any disclaimer, the term of this patent is extended or adjusted under 35 U.S.C. 154(b) by 0 days.

(21) Appl. No.: 12/606,036

(22) Filed: Oct. 26, 2009

(65) Prior Publication Data

US 2010/0047381 A1 Feb. 25, 2010

Related U.S. Application Data

(60) Division of application No. 11/327,344, filed on Jan. 9, 2006, now Pat. No. 7,645,321, which is a continuation of application No. PCT/AT2004/000248, filed on Jul. 9, 2004.

(30) Foreign Application Priority Data

Jul. 16, 2003 (AT) ..... 1110/2003

(51) Int. Cl.
*C22B 1/212* (2006.01)

(52) U.S. Cl. ..... 266/177; 266/142

(58) Field of Classification Search ..... 266/142, 266/143, 177

See application file for complete search history.

(56) References Cited

U.S. PATENT DOCUMENTS 3,914,364 A * 10/1975 Engelleitner et al. ..... 264/117
3,964,599 A * 6/1976 van Langen et al. ..... 222/55
4,421,521 A * 12/1983 Barber ..... 44/557
6,802,886 B2 * 10/2004 Hoffman et al. ..... 75/484

FOREIGN PATENT DOCUMENTS

| | | |
|---|---|---|
| EP | 0 415 146 | 6/1991 |
| JP | 62-227047 | 10/1987 |
| JP | 5-340871 | 12/1993 |
| JP | 2003138319 A | 5/2003 |

OTHER PUBLICATIONS

Japanese Decision of Rejection, dated May 6, 2010, issued in corresponding Japanese Patent Application No. 2006-519722, total 2 pages. English Translation attached, 2 pages.

Brazilian Office Action in corresponding Brazilian Application No. PI0412587-8 published on Jul. 3, 2012.

* cited by examiner

*Primary Examiner* — Scott Kastler
(74) *Attorney, Agent, or Firm* — Ostrolenk Faber LLP

(57) ABSTRACT

A plant for the production of ore comprising a proportion of fines, additives and green agglomerates optionally containing a binder, provided with an outer coating consisting of a combustible containing fine-grained carbon, such as coke. In the plant, the ore is mixed with the additives and the optionally available binder. The mixture is pelletized and the green agglomerates thus formed are coated with the combustible, whereby the combustible is introduced into an agglomeration drum. In order to enable continual production of homogeneous-quality green agglomerates, the mixture is pelletized in the agglomeration drum and the combustible is added in an area of the longitudinal extension of the agglomeration drum where the size of the green agglomerates formed in the agglomeration drum is sufficient for further processing.

11 Claims, 4 Drawing Sheets

Figure 1:
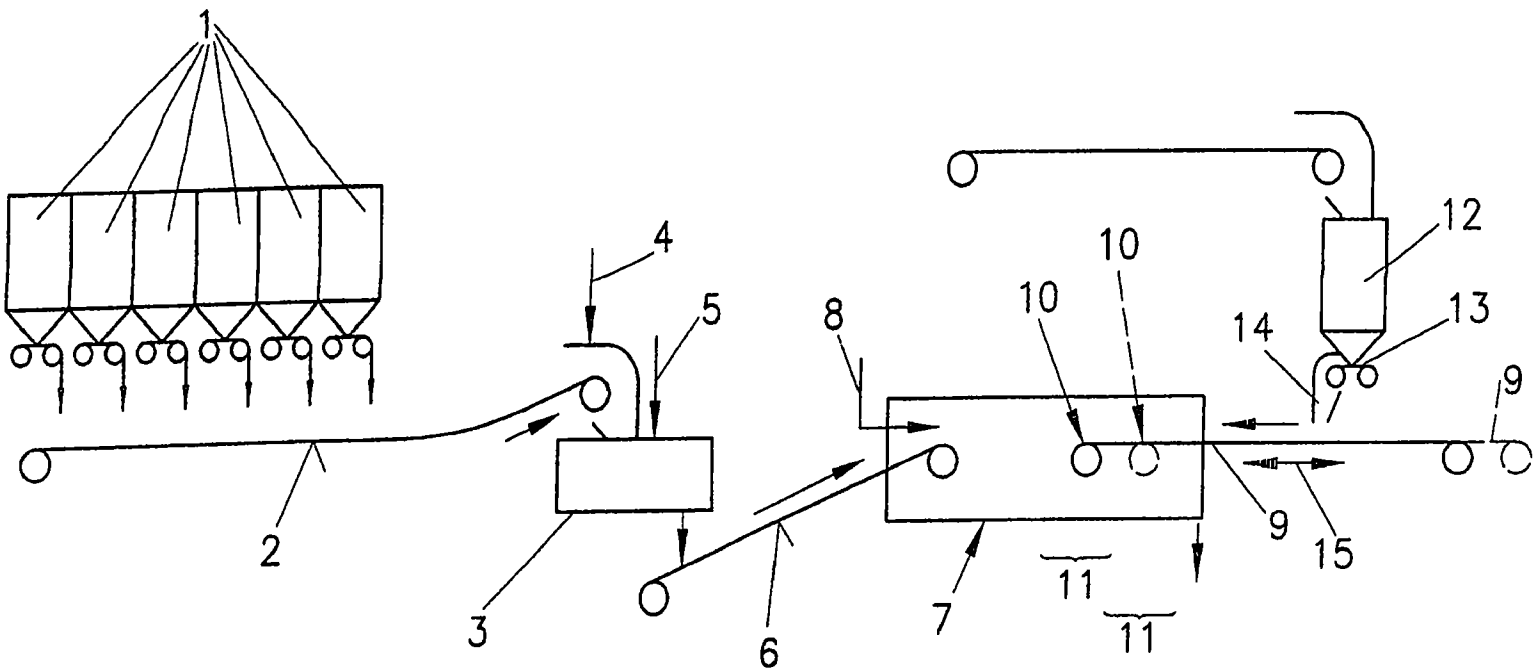

SYSTEM FOR THE PRODUCTION OF ORE WITH GREEN AGGLOMERATES CONTAINING A PROPORTION OF FINES

CROSS REFERENCE TO RELATED APPLICATIONS

This application claims the benefit under 35 U.S.C. §§120, 121 as a division of U.S. patent application Ser. No. 11/327,344, filed 9 Jan. 2006 now U.S. Pat. No. 7,645,321 B2 by Oskar PAMMER, et al., and entitled METHOD FOR THE PRODUCTION OF ORE WITH GREEN AGGLOMARATES CONTAINING A PROPORTION OF FINES, now allowed, which is a continuation (35 U.S.C. §365) of International Application Serial No. PCT/AT2004/000248, filed 9 Jul. 2004, published 27 Jan. 2005 as WO 2005/007899 in the German language, which in turn claims the priority of Austrian National Application Serial No. A 1110/2003, filed 16 Jul. 2003. The entire contents and disclosures of the abovementioned applications are incorporated herein by their reference for all purposes.

BACKGROUND OF THE INVENTION

1. Field of the Invention

The invention relates to a process for the production of ore comprising green agglomerates containing an amount of fines, fluxes and optionally a binder, which green agglomerates are provided with an outer coating formed from a combustible containing fine-grained carbon, such as coke, and optionally a binder, wherein the ore is mixed with the fluxes and the optionally provided binder, the mixture is pelletized and the green agglomerates thus formed are coated with the combustible in an agglomeration drum, with the combustible being added, as well as to a plant for carrying out the process.

2. Description of Related Art

A process of this kind is known from EP A2 0 271 863. According to this document, the ore having an amount of fines, the fluxes and the binder are pelletized with the aid of pelletizing disks. The green agglomerates thus formed are subsequently transferred into a tumble drum in which they are coated with coke breeze.

The disadvantage thereof is that pelletizing disks only have a limited capacity, i.e., a plurality of pelletizing disks must be provided for a comparatively large and powerful installation, whereas it is sufficient to provide a single agglomeration drum for coating the green agglomerates formed in the pelletizing disks. The coupling of the plurality of pelletizing disks with a single agglomeration drum is complicated, particularly since conveying means must lead from each of the pelletizing disks to the agglomeration drum. This type of conveyance might involve the destruction of a portion of the green agglomerates formed. Furthermore, it is difficult to carry out this known process in a continuous fashion, normally, irregular flow rates per unit of time occur in the agglomeration drum, depending on how the pelletizing disks are charged and how the pelletizing operation proceeds on the pelletizing disks. A further disadvantage is that the readjustment to different ores and different grain-size distributions, respectively, with varying moisture contents, respectively, is complex, particularly since, in such cases, the time for forming the green agglomerates on the pelletizing disks varies.

SUMMARY OF THE INVENTION

The invention aims at avoiding said disadvantages and difficulties and has as its object to provide a process and a plant for carrying out the process, respectively, which ensure a uniform and continuous method of producing said green agglomerates. In addition, the process should merely require a not very complex plant also for large flow rates per unit of time. It is a specific concern of the invention to enable a readjustment to different modes of operation—caused by different compositions of fine ores and different fluxes, respectively, etc.—in a particularly simple manner.

According to the invention, this object is achieved in a process of the initially described kind by pelletizing the mixture in the agglomeration drum and adding the combustible in an area of the longitudinal extension of the agglomeration drum where the green agglomerates forming in the agglomeration drum have the desired size for further processing.

It is advantageous for said process if mixing is effected intensively, which suitably is performed by scooping through the materials to be mixed, preferably using a horizontal or vertical shaft mixer.

A particularly simple adjustment of the process according to the invention to different modes of operation, different ores, different ore compositions etc. is characterized in that the area of adding the combustible into the agglomeration drum is varied throughout the length of the agglomeration drum, depending on the nature and size of the green agglomerates.

A plant for the production of ore comprising green agglomerates containing an amount of fines, fluxes and optionally a binder, which green agglomerates are provided with an outer coating formed from a combustible containing fine-grained carbon, such as coke, which plant comprises a mixer for the ore, the fluxes and the optionally provided binder, with a pelletizing device arranged downstream thereof, is characterized in that the pelletizing device is designed as an agglomeration drum which, in an area within its longitudinal extension, is provided with a charging means for the combustible.

A preferred embodiment is characterized in that the charging means is variable, whereby the area of the longitudinal extension where said means delivers the combustible into the agglomeration drum is changed.

Preferably, the charging means is designed as a conveyor belt projecting into the agglomeration drum, wherein the conveyor belt speed is suitably variable or the position of the conveyor belt relative to the longitudinal extension of the agglomeration drum and hence the output area of the conveyor belt are changeable.

Conveying screws projecting into the agglomeration drum or drag-link conveyors can also be provided as charging means which preferably can likewise be moved in the longitudinal direction of the agglomeration drum.

In order to achieve thorough mixing and hence a favourable formation of green agglomerates, the mixer is suitably designed as a horizontal or vertical shaft mixer with blades arranged on the shaft or on the shafts, respectively.

According to a preferred embodiment, the mixer is formed integrally with the agglomeration drum so that, as soon as the mixing of the ore with the fluxes and the optionally provided binder is completed, a direct transfer into the agglomeration drum occurs, whereby a separate conveying means from the mixer to the agglomeration drum becomes unnecessary.

It has turned out to be convenient for implementing the process according to the invention if the area of the longitudinal extension, where the charging means for the combustible adds the same into the agglomeration drum, is located between the first third and the final fourth of the longitudinal extension of the agglomeration drum, preferably between the half and two thirds of the longitudinal extension of the agglomeration drum.

Other features and advantages of the present invention will become apparent from the following description of the invention which refers to the accompanying drawings.

BRIEF DESCRIPTION OF THE DRAWING(S)

Below, the invention is explained in further detail by way of several exemplary embodiments with reference to the drawing, wherein FIGS. 1 to 4 each illustrate a variant in a schematic flow chart design.

DETAILED DESCRIPTION OF EMBODIMENTS OF THE INVENTION

According to the embodiment illustrated in FIG. 1, ores and fluxes, wherein a combustible such as coke can also be provided as a flux, are taken from bunkers 1 arranged side by side and, from there, get onto a conveying means such as a conveyor belt 2 which conveys said materials to a mixer 3 which preferably is designed as a high-performance mixer as will be described later.

Immediately before charging these materials into the mixer 3, a binder such as burnt lime is additionally added to the materials via a supply 4. For optimizing the mixing process and also the agglomeration process which has to be carried out subsequently, a certain amount of water is added via a feed line 5 in the mixer 3 in order to obtain a particular optimum moisture.

Via a conveying means such as a conveyor belt 6, the mixture discharged from the mixer 3 reaches an agglomeration drum 7 in which the mixture is granulated and in which also the required final moisture is adjusted via a water supply 8. While green agglomerates are increasingly being formed which are supposed to finally exhibit a size of preferably between 2 and 8 mm, the material gets from a feed end of the agglomeration drum 7 to the opposite output end from where it is conveyed onward for further processing. Such further processing is preferably effected by sintering in a belt-type sintering plant.

In the illustrated example, the agglomeration drum 7 is arranged in a horizontal position; however, it can also be arranged in a slightly inclined position so as to increase the discharge capacity. This also applies to the mixer 3, if said mixer is designed as a drum mixer or as a high-performance mixer.

In order to be able to influence the formation of optimum green agglomerates having a grain size of approx. between 2 and 8 mm, in particular with regard to the maximum grain size thereof, the green agglomerates—so-called green pellets—are coated with a fine-grained combustible, preferably coke breeze, as soon as their optimum grain size has been reached. According to the invention, this takes place inside the agglomeration drum 7 in which a charging means 9 for the combustible is provided at a particular point of the longitudinal extension of the agglomeration drum 7. Said charging means 9 is preferably designed as a conveyor belt the discharge point 10 of which determines the area 11 where the combustible is added to the green agglomerates. The charging of the combustible onto the conveyor belt 9 is effected by means of a bunker 12, a weighing belt 13 and a feed chute 14. The combustible can be provided with a fine-grained binder such as, for example, with burnt lime, hydrate lime or blast-furnace slag having a glass-like structure.

Preferably, the conveyor belt 9 projects into the agglomeration drum 7 beyond an end thereof and extends in the longitudinal direction of the agglomeration drum 7.

Instead of the conveyor belt 9, other charging means may also be provided, for example, a screw conveyor or a drag-link conveyor etc.

The area 11 of the discharge of the combustible, i.e. the area where the combustible first contacts the green agglomerates, is advantageously variable, which can be achieved by changing the conveyor belt speed so that the discharge parabola for the combustible is modified. This may also be achieved by moving the conveyor belt 9 in the longitudinal direction of the agglomeration drum 7, as illustrated in the drawing by a double arrow 15.

Starting with the area where the green agglomerates first contact the combustible, said green agglomerates are coated with the combustible and are stabilized in this way; further growth of green agglomerates is thus avoided. An optionally provided coarser portion of the combustible, i.e. of the coke preferably used, is distributed between the coated green agglomerates.

The specific advantage of the invention is that, immediately after their formation, the green agglomerates are stabilized regarding their shape by being coated with the combustible, which takes place immediately afterwards. This means that the green agglomerates do not need to be conveyed from a pelletizing device such as a pelletizing disk to a combustible-coating device, which is designed either as another pelletizing disk or as an agglomeration drum. Due to the fact that the green agglomerates, immediately after they have reached the correct size within the agglomeration drum 7, are coated with a combustible rather than being subjected to intermediate conveyance, a precise granulation of the green agglomerates can be achieved and a destruction thereof, which may occur during intermediate conveyance, is reliably avoided.

Thus, the invention permits the processing of sintered raw mixtures with a large amount of fines into comparatively coarse green agglomerates in a particularly inexpensive manner. According to the invention, the grain size of the green agglomerates can easily be adjusted within the length of the agglomeration drum 7 by modifying the area where the green agglomerates contact the combustible. The coated green agglomerates thus formed show a good capability of fumigation in a sintering machine, whereby a sintering plant of high productivity can be achieved. The improved permeability also allows the consumption of electric energy in a sintering machine to be minimized. The sinter thus produced then has a high and stable quality and, e.g. for iron ore, a small amount of FeO, which leads to good reducibility in a blast furnace. As a result of the good permeability of the charging stock now consisting primarily of green agglomerates, the content of secondary air in the processing gases is low during sintering.

Figure 2:
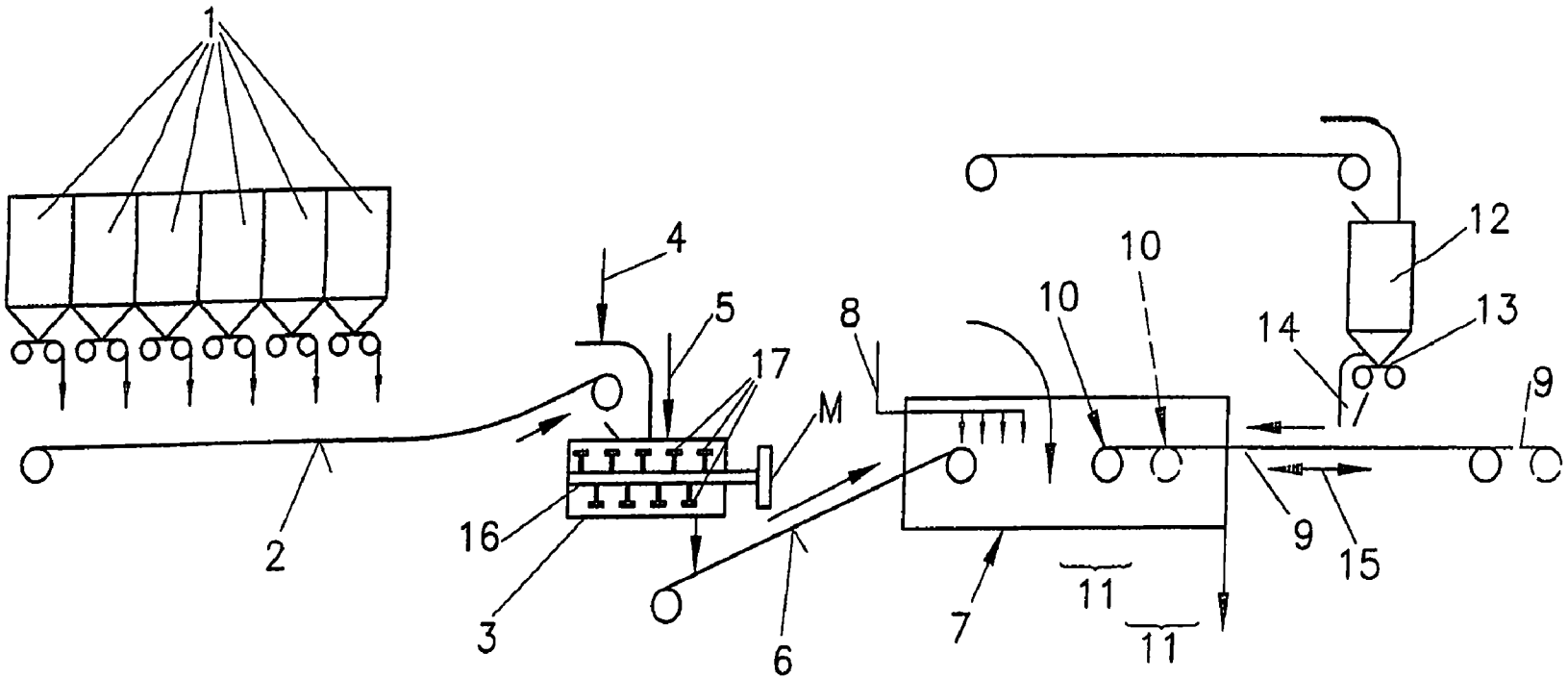

According to the embodiment illustrated in FIG. 2, the mixer 3 is designed as a high-performance mixer comprising a horizontal powered shaft 16 activated at M on which blades 17 radially extending outwards are arranged. The use of such a high-performance mixer allows the moisture of the green agglomerates to fall to a minimum value, whereby it is possible to achieve an additional increase in the productivity on a sintering machine. Furthermore, the materials in the mixture are distributed in an especially homogeneous manner, ensuring a consistent quality of the final product.

Figure 3:
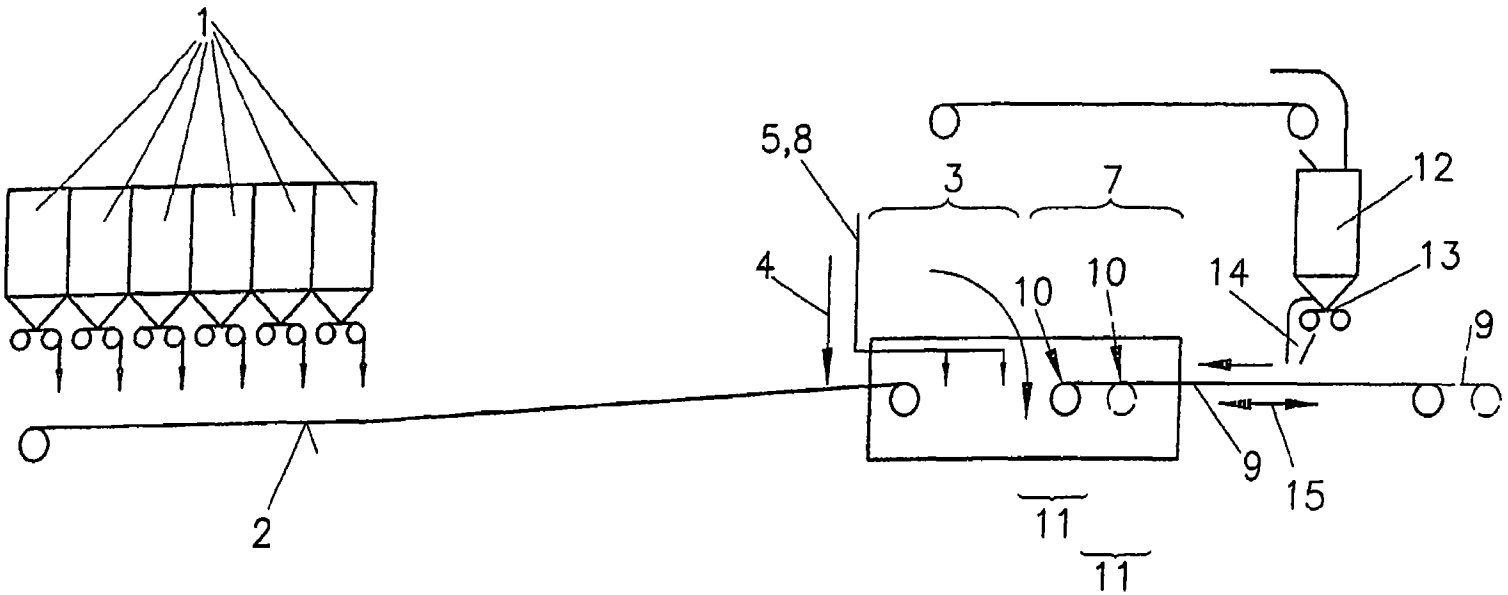

According to the variant illustrated in FIG. 3, the mixer 3 is formed integrally with the agglomeration drum 7, i.e., the mixture is introduced via the conveyor belt 2 directly into a drum the first part of which acts as the mixer 3 and the further part of which acts as the agglomeration drum 7 in which also the addition of coke breeze occurs.

Figure 4:
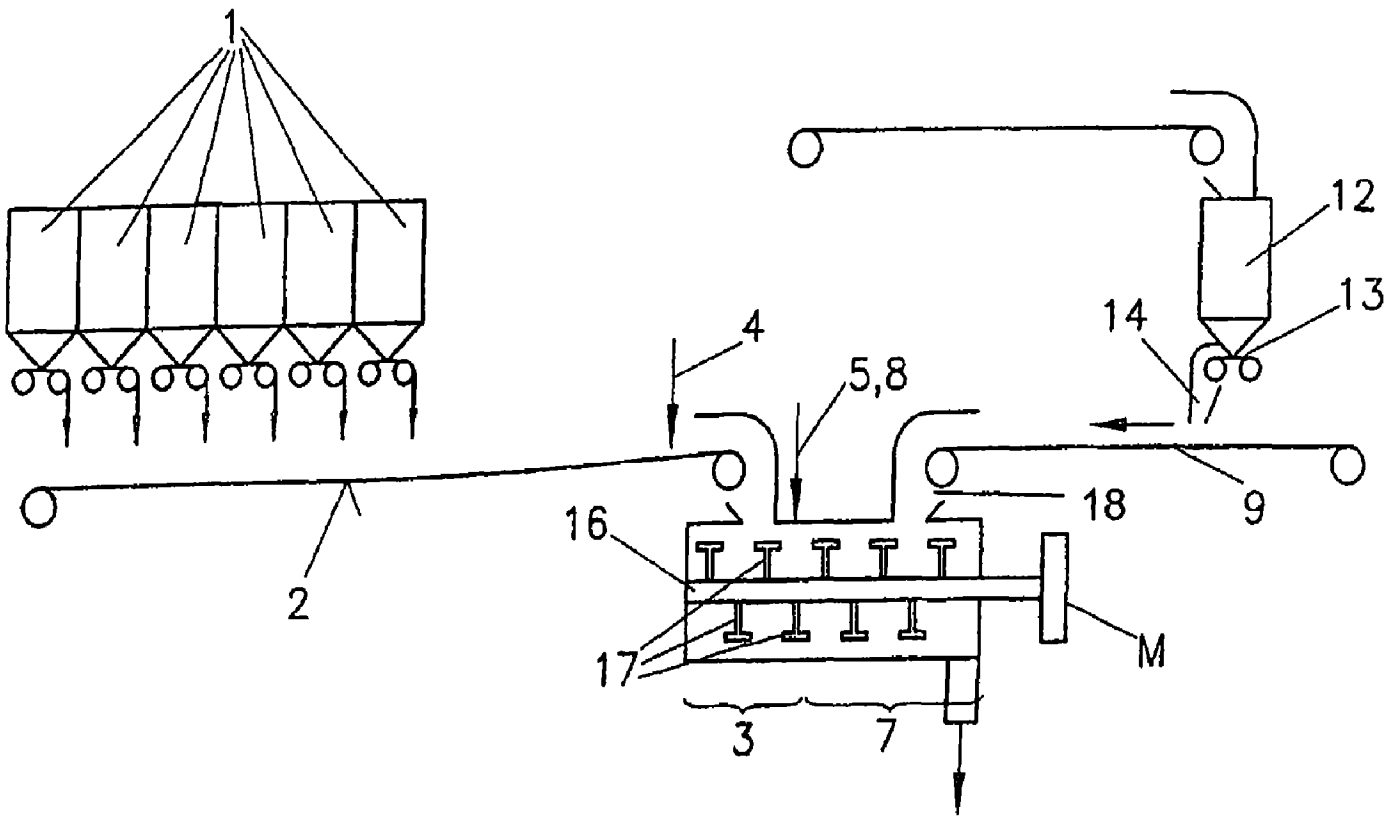

In the embodiment illustrated in FIG. 4, the agglomeration drum 7 is likewise formed integrally with the mixer 3, with the agglomeration drum 7, however, being arranged fixedly, i.e. stationary, on the foundation and with at least one shaft 16 comprising blades 17 being arranged in the interior of the agglomeration drum. Said shaft 16 comprising blades 17 also penetrates the mixer 3 and can be activated at M. Via an opening 18 which can be placed optionally, the charging means 9 runs into the agglomeration drum 7. According to said embodiment, mixing and agglomerating as well as coating take place in a single device—a mixing agglomerator—, wherein the various requirements arising during mixing, agglomerating and coating are taken into consideration by the different designs of the blades 17 in the individual areas of said agglomeration drum 7.

According to an exemplary embodiment, 40% of the employed grains of an iron ore to be processed exhibit a size of less than 0.125 mm. 460 t/h of raw materials, i.e., of iron ore, fluxes and binder, are introduced into the mixing device 3. The moisture amounts to 3 to 4%. In the mixer, water is added to the materials introduced into the mixer 3 so that the moisture of the prepared mixture lies between 5 and 6%.

The mixture thus produced is introduced into the agglomeration drum 7, into which an additional amount of 8 t/h of coke breeze with a moisture of about 10% and a grain size of less than 1 mm is fed. This yields an output of green agglomerates of 468 t/h (dry) with a moisture of about 6%. The grain size of the green agglomerates ranges between 2 and 8 mm.

The ore-green agglomerates thus produced are perfectly suitable for sintering owing to the good permeability of said green agglomerates.

The invention is not limited to the production of green agglomerates from iron ore but is applicable also for non-iron ores such as lead ore or manganese ore.

What is claimed is:

1. A plant for the production of ore comprising green agglomerates containing an amount of fines and fluxes, the green agglomerates being provided with an outer coating formed from a combustible containing fine-grained carbon, the plant comprising:

a mixer for the ore and the fluxes; and a pelletizing device arranged downstream of the mixer, wherein the pelletizing device is configured as an agglomeration drum having an area within its longitudinal extension provided with a charging means for the combustible, the charging means comprising a conveyor belt projecting into the agglomeration drum, the conveyor belt delivering the combustible into the agglomeration drum, the conveyor belt being configured such that the position of the conveyor belt relative to the longitudinal extension of the agglomeration drum may be varied while the conveyor belt is operating, and thereby the output area of the conveyor belt is changeable, the green agglomerates being provided with the outer coating formed from the combustible in the agglomeration drum.

2. A plant according to claim 1, wherein the charging means is variable, whereby the area of the longitudinal extension where said means delivers the combustible into the agglomeration drum is changed.

3. A plant according to claim 1, wherein the charging means is configured as one of a conveying screw or drag-link conveyor, the charging means projecting into the agglomeration drum.

4. A plant according to claim 1, wherein the mixer is configured as a horizontal or vertical shaft mixer having one or more shafts, with blades arranged on the shaft or on the shafts, respectively.

5. A plant according to claim 1, wherein the mixer is formed integrally with the agglomeration drum.

6. A plant according to claim 5, wherein the mixer and the agglomeration drum are configured as a stationary mixing agglomerator, at least one mixing tool, such as a shaft comprising blades, being provided in the mixer and the charging means for the combustible runs into the agglomeration drum via an opening thereof.

7. A plant according to claim 1, wherein the area of the longitudinal extension, where the charging means for the combustible adds the combustible into the agglomeration drum, is located between the first third and the final fourth of the longitudinal extension of the agglomeration drum.

8. A plant according to claim 3, wherein the charging means can be moved in the longitudinal direction of the agglomeration drum.

9. A plant according to claim 7, wherein the charging means for the combustible is located between half and two thirds of the longitudinal extension of the agglomeration drum.

10. A plant according to claim 1, wherein the charging means for the combustible is configured and operative to discharge the combustible into the agglomeration drum over an area of the agglomeration drum that is variable with the speed of the conveyor belt.

11. A plant according to claim 1, wherein the charging means for the combustible is configured and operative to discharge the combustible into the agglomeration drum in a discharge parabola that is variable with the speed of the conveyor belt.

* * * * *